US005731827A

United States Patent [19]

Mantell et al.

[11] Patent Number: 5,731,827

[45] Date of Patent: Mar. 24, 1998

[54] LIQUID INK PRINTER HAVING APPARENT 1XN ADDRESSABILITY

[75] Inventors: David A. Mantell, Rochester; Thomas A. Tellier, Wolcott; Gary A. Kneezel, Webster; Steven J. Harrington, Holley; James F. O'Neill; Narayan V. Deshpande, both of Penfield; Peter A. Torpey, Webster, all of N.Y.

[73] Assignee: Xerox Corporation, Stamford, Conn.

[21] Appl. No.: 539,890

[22] Filed: Oct. 6, 1995

[51] Int. Cl.[6] ..... B41J 2/145; B41J 2/15; B41J 29/38

[52] U.S. Cl. ..... 347/40; 347/9

[58] Field of Search ..... 347/40, 56, 68, 347/9, 12, 15

[56] References Cited

U.S. PATENT DOCUMENTS

| | | | |
|---|---|---|---|
| 4,714,934 | 12/1987 | Rogers | 346/140 R |
| 4,901,093 | 2/1990 | Ruggiero et al. | 346/140 R |
| 5,258,774 | 11/1993 | Rogers | 346/1.1 |
| 5,270,728 | 12/1993 | Lund et al. | 346/1.1 |
| 5,412,410 | 5/1995 | Rezanka | 347/15 |

FOREIGN PATENT DOCUMENTS

| | | |
|---|---|---|
| 623473A2 | 11/1994 | European Pat. Off. . |
| 59-109375 | 6/1984 | Japan . |

OTHER PUBLICATIONS

Snyder, Roger R.D., "A Segemented Drop Generator", Xerox Disclosure Journal, vol. 9, No. 2, Mar./Apr. '84, pp. 125–127.

*Primary Examiner*—Benjamin R. Fuller
*Assistant Examiner*—Thinh Nguyen
*Attorney, Agent, or Firm*—Daniel J. Krieger

[57] ABSTRACT

A liquid ink printing apparatus printing images includes a printhead having a plurality of nozzles wherein a single power pulse causes two or more nozzles to eject ink simultaneously. The printhead includes an ink directing element having a plurality of ink conduits coupled to an array of spaced nozzles and a transducer element aligned with and mated to the ink directing element. The transducers are spaced a distance apart and each transducer is substantially aligned with at least two or more of the nozzles. The printhead is stepped in a direction transverse to the array of spaced nozzles a stepping distance approximately equal to or less than the distance between transducers. The ink directing element includes a silicon wafer having etched ink conduits or channels holding ink for ejection through the nozzles connected thereto. Each transducer is cooperatively associated with one channel having a fork member coupled to two or more nozzles or is cooperatively associated with two or more channels wherein each channel is connected to one or more nozzles.

22 Claims, 9 Drawing Sheets

(1/2 2)x2

LIQUID INK PRINTER HAVING APPARENT 1XN ADDRESSABILITY

FIELD OF THE INVENTION

The present invention relates generally to a liquid ink printing apparatus, and more particularly to an ink jet printer including a printhead having a plurality of nozzles wherein a single power pulse causes two or more nozzles to eject ink simultaneously.

BACKGROUND OF THE INVENTION

Liquid ink printers of the type frequently referred to as continuous stream or as drop-on-demand, such as piezoelectric, acoustic, phase change wax-based, or thermal, have at least one printhead from which droplets of ink are directed towards a recording medium. Within the printhead, the ink is contained in a plurality of ink conduits or channels. Power pulses cause the droplets of ink to be expelled as required from orifices or nozzles at the ends of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges toward the channel orifice followed by collapse of the bubble. The ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of the recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Printers typically print information received from an image output device such as a personal computer. Typically, this received information is in the form of a raster scan image such as a full page bitmap or in the form of an image written in a page description language. The raster scan image includes a series of scan lines consisting of bits representing pixel information in which each scan line contains information sufficient to print a single line of information across a page in a linear fashion. Printers can print bitmap information as received or can print an image written in the page description language once converted to a bitmap consisting of pixel information.

Bitmaps printed by a printer can be printed at the resolution of the received bitmap. The printer can also modify the received bitmap and print the information at a resolution different than the one received. In either event, it is generally believed, under most circumstances, that the higher the resolution of the printed image, or the higher the perceived resolution of the printed image, the better that image will be received by one viewing the image. Consequently, most printer manufacturers strive to print higher resolution images by either producing printheads having more ink ejecting nozzles per inch or by artificially creating the appearance of higher resolution images with printing algorithms which manipulate or alter the received bitmap.

Various methods and apparatus for printing images with scanning carriage type liquid ink printers have been developed, some of which, provide higher resolution, in one direction, i.e. the scanning direction, and not in the another direction, i.e. the recording medium advance direction. The following references describe these and other methods and apparatus for liquid ink printing.

In U.S. Pat. No. 4,714,934 to Rogers, an impulse ink-jet apparatus capable of printing bar codes having a plurality of side-by-side chambers extending along a line slanted with respect to the direction of scanning is described. Each of the chambers includes a plurality of orifices arranged along a line extending substantially transverse to the scanning direction. Droplets are simultaneously ejected from a plurality of orifices by energizing a single transducer, such that bar code and alpha-numeric printing is achieved.

U.S. Pat. No. 4,901,093 to Ruggiero et al, describes an impulse ink-jet apparatus providing bar codes using one or more ink-jet chambers having a plurality of orifices in each chamber. A transducer is coupled to each chamber for ejecting droplets from each of the plurality of orifices in the chamber in response to the state of energization of the transducer.

U.S. Pat. No. 5,258,774 to Rogers, describes an impulse ink-jet apparatus having a plurality of side-by-side chambers extending along a line that is slanted with respect to a scanning direction relative to a recording medium. Each of the chambers includes a plurality of orifices that are arranged along a line extending substantially transverse to the scanning direction and a transducer for ejecting a plurality of droplets from the orifices of each chamber.

U.S. Pat. No. 5,270,728, to Lund et al., describes a method for multiplying the speed-resolution product of a raster scanning or imaging device such as an ink jet printer, and a resulting data structure. A 300 dots per inch (dpi) by 600 dpi logical pixel image is mapped to a corresponding, non-overlapping physical dot image. The printer's ink jets are fired responsive to the dot image to direct individual generally spherical ink droplets onto paper at 600 dpi resolution grid timing in order to effectively double the horizontal resolution of the printed pixel image.

European Patent Application Publication No. 623 473 to Holstun et al, describes increased print resolution in the carriage scan axis of an ink-jet printer. The increased print resolution is achieved by moving the carriage of an ink-jet cartridge in the carriage scan direction to provide a first resolution in that direction which is twice the second resolution in a print media advance direction. Two smaller drops of ink are fired onto each square pixel in a single pass of the cartridge so as to provide, for example, a 600 dpi resolution in the carriage scan axis with a 300 dpi resolution in the media advance direction.

Japanese Laid Open publication number 59-109375, laid open Jun. 25, 1984, describes a method to enable printing with a high-dot density wherein dot matrix patterns are printed while reducing the pitch in the scanning direction of a head when forwardly moving the head, and the patterns are printed in the same line by upwardly or downwardly staggering the printhead by one-half dot pitch when backwardly moving the head in a wire dot serial printer.

Xerox Disclosure Journal, Volume 9, Number 2, March/April 1984, pages 125 to 127, describes a segmented drop generator for a continuous ink-jet device. A plurality of structures mounted on a common base each have an independent, sandwich-type piezoelectric driving element, an independent ink replenishment reservoir, and a nozzle plate having multiple nozzles. Each nozzle is connected to the ink replenishment reservoir by an individual channel.

SUMMARY OF THE INVENTION

In accordance with one aspect of the present invention, there is provided a printing machine of the type in which liquid ink is deposited on a recording medium. The printing machine includes a printhead having a plurality of transducers having centers spaced a first distance, S, apart, and a plurality nozzles, each of the plurality of transducers cooperatively associated with at least two of the plurality of nozzles. The printing machine further includes a means for moving the printhead across the recording medium to deposit liquid ink thereon at locations separated by a distance selected as a function of the first distance, S, divided by the number of nozzles cooperatively associated with each of said plurality of nozzles.

Pursuant to another aspect of the present invention, there is provided a method of printing an image on a recording medium with a liquid ink printhead having transducers ejecting ink droplets on the recording medium. The method includes the steps of depositing a first plurality of ink droplets simultaneously, having centers spaced a first distance apart, by energizing a first transducer, and depositing a second plurality of ink droplets simultaneously, spaced from the first plurality of ink droplets by the first distance.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
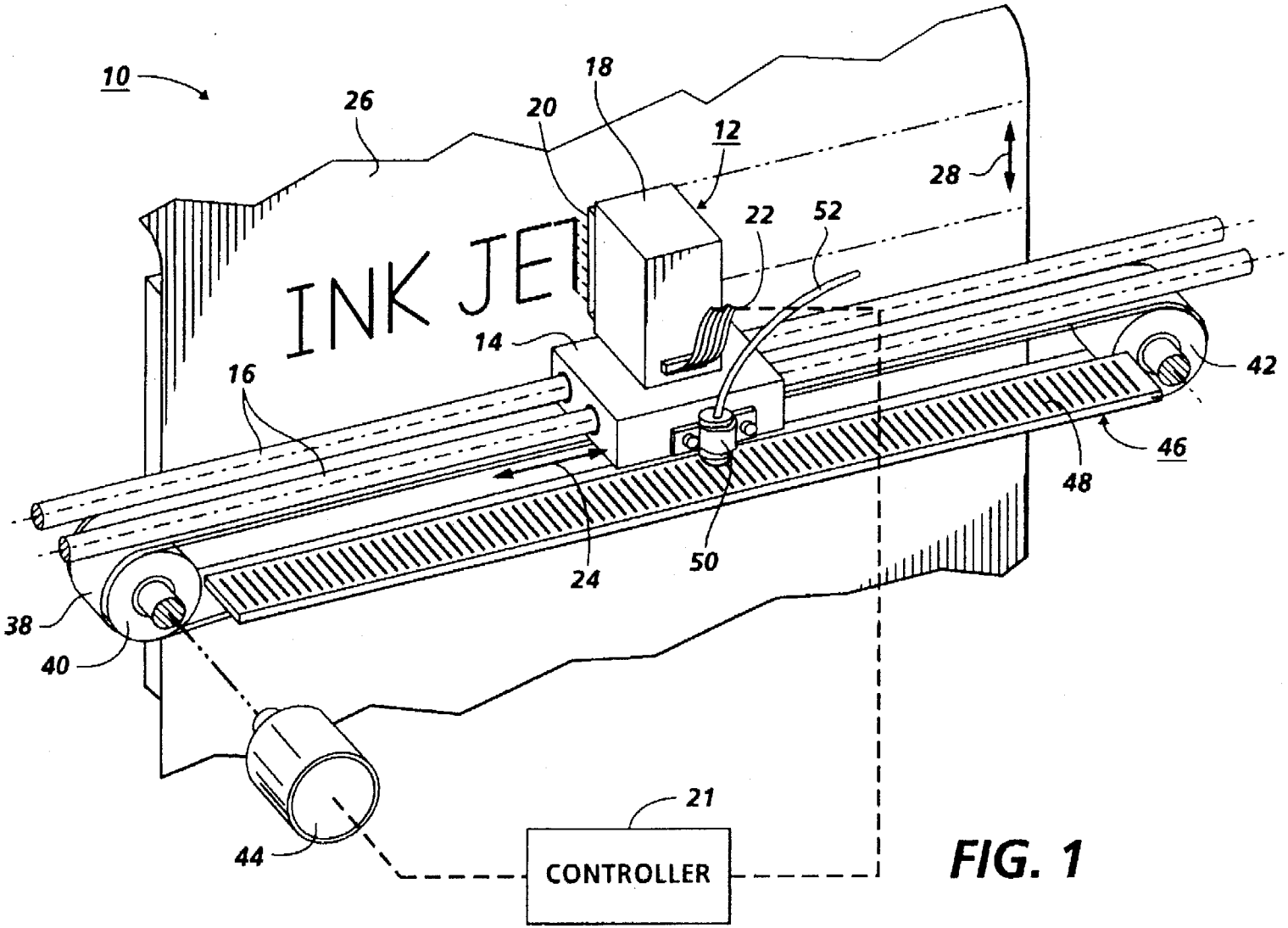
FIG. 1 is a partial schematic perspective view of an ink jet printer incorporating the present invention.

FIG. 1 illustrates a partial schematic perspective view of an ink jet printer 10 having an ink jet printhead cartridge 12 mounted on a carriage 14 supported by carriage rails 16. The printhead cartridge 12 includes a housing 18 containing ink for supply to a thermal ink jet printhead 20 which selectively expels droplets of ink under control of electrical signals received from a controller 21 of the printer 10 through an electrical cable 22. The printhead 20 contains a plurality of ink conduits or channels (not shown) which carry ink from the housing 18 to respective ink ejectors, which eject ink through orifices or nozzles (also not shown). When printing, the carriage 14 reciprocates or scans back and forth along the carriage rails 16 in the directions of the arrow 24. As the printhead cartridge 12 reciprocates back and forth across a recording medium 26, such as a sheet of paper or transparency, droplets of ink are expelled from selected ones of the printhead nozzles towards the sheet of paper 26. The ink ejecting orifices or nozzles are typically arranged in a linear array substantially perpendicular to the scanning direction 24. During each pass of the carriage 14, the recording medium 26 is held in a stationary position. At the end of each pass, however, the recording medium is stepped by a stepping mechanism under control of the printer controller 21 in the direction of an arrow 28. For a more detailed explanation of the printhead and printing thereby, refer to U.S. Pat. No. 4,571,599 and U.S. Pat. No. Reissue 32,572, the relevant portions of which are incorporated herein by reference.

It is well known and commonplace to program and execute imaging, printing, document, and/or paper handling control functions and logic with software instructions for conventional or general purpose microprocessors. This is taught by various prior patents and commercial products. Such programing or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, the disclosed system or method may be implemented partially or fully in hardware, using standard logic circuits or a single chip using VLSI designs.

The carriage 14 is moved back and forth in the scanning directions 24 by a belt 38 attached thereto. The belt 38 is driven by a first rotatable pulley 40 and a second rotatable pulley 42. The first rotatable pulley 40 is, in turn, driven by a reversible motor 44 under control of the controller 21 of the ink jet printer. In addition to the toothed belt/pulley system for causing the carriage to move, it is also possible to control the motion of the carriage by using a cable/capstan, lead screw or other mechanisms as known by those skilled in the art.

To control the movement and/or position of the carriage 14 along the carriage rails 16, the printer includes an encoder having an encoder strip 46 which includes a series of fiducial marks in a pattern 48. The pattern 48 is sensed by a sensor 50, such as a photodiode/light source attached to the printhead carriage 14. The sensor 50 includes a cable 52 which transmits electrical signals representing the sensed fiducial marks of the pattern 48 to the printer controller.

Figure 2:
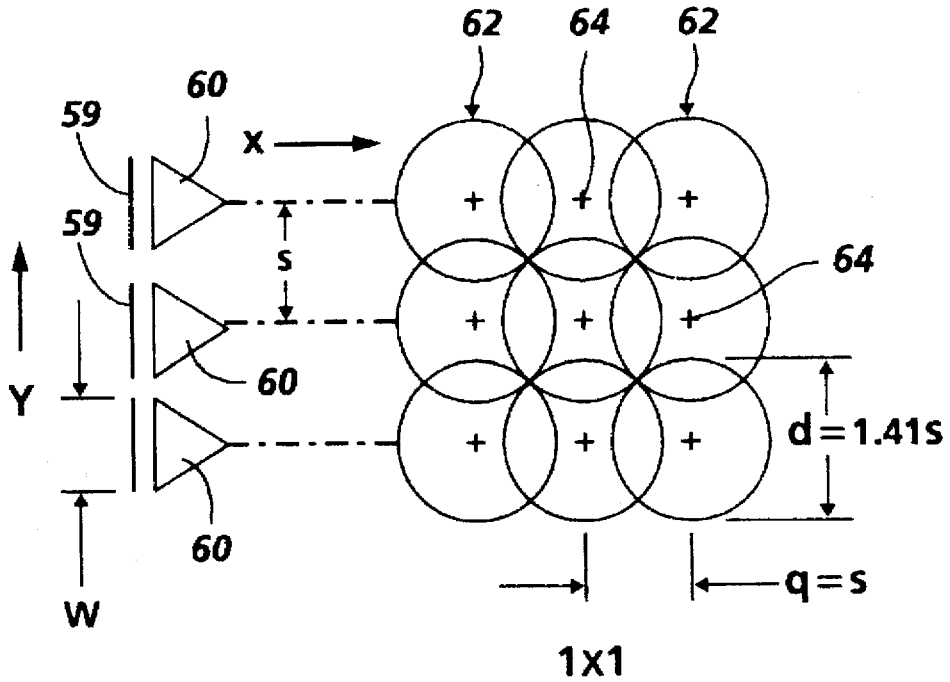
FIG. 2 illustrates the locations of ink drops deposited by a printhead in a 1 by 1 pattern.

FIG. 2 illustrates the locations of ink drops deposited by a printhead in a 1×1 pattern as known in the art. In such a printhead, for instance printing at 300 spots per inch, the pixels are placed on a square grid having a size S where S is generally the spacing between the marking transducers 59 or channels (not shown) on the printhead as schematically illustrated. The nozzles 60, schematically represented as triangles, each associated with a single transducer 59, traverse across a recording medium in a scan direction X as illustrated. Other nozzle shapes are also possible such as those formed by isotropic etching, having rounded features, or by plasma etching, having angular or trapezoidal features. The nozzles, which are spaced from one another a specified distance S, also known as the pitch, deposit ink spots 62 on a grid, wherein the ink spots have pixel centers 64 spaced a distance S apart. The ink nozzles 60 are designed to produce spot diameters of approximately 1.414 (the square root of 2) times the grid spacing S, which is here illustrated as the distance D. This distance provides complete filling of space by enabling diagonally adjacent pixels to touch. Consequently, in 1×1 printing (e.g., 300×300), the spots need to be at least 1.41 S to cover the paper. In practice however, the ink spots or pixels may be made slightly larger to ensure full coverage of the paper.

Figure 3:
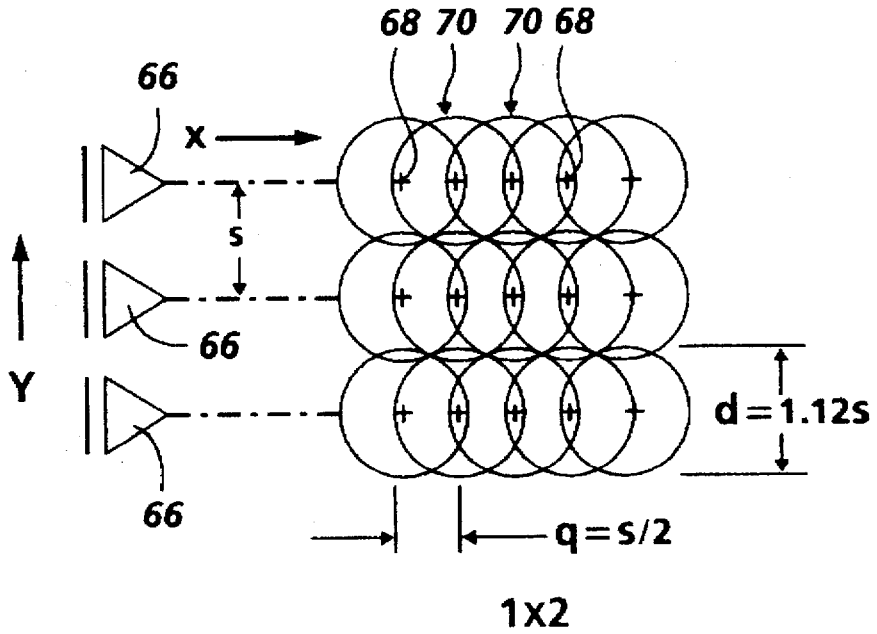
FIG. 3 illustrates the locations of ink drops deposited by a printhead in a 1 by 2 pattern.

FIG. 3 illustrates the locations of ink drops deposited by a printhead in a 1×2 pattern, wherein the printhead includes a plurality of nozzles 66 having the same pitch S as the schematically represented printhead illustrated in FIG. 2. In FIG. 3, however, the printhead is printing at 300×600 pixels addressability, meaning that the nozzle spacing is 300 dots per inch in the Y direction, but 600 dots per inch in the X direction or scanning direction of the carriage. To print at 600 dots per inch in the scanning direction, the distance between pixel centers 68 of the individual ink drops 70 is S divided by 2. When printing at 600 spots per inch in the scanning direction or, more generally, at twice the resolution of the printhead addressability, the spot size can be reduced to 1.12 S This particular drop size requires two drops, each of which produce a little over one-half of the ink of the larger 1×1 spot area as illustrated in FIG. 2. The relationship of drop size to printing schemes is as follows:

$1\times1$: $1.41^2=2$;

$1\times2$: $2\times(1.12^2)=2.5$

Assuming a constant thickness model for the translation from drop volume to spot size in 1×2 addressability printing, full coverage would require 25% more ink than in 1×1 addressability printing. The exact relationship, of course, depends on the specific ink and paper or transparency being covered.

Certain trade-offs are made when increasing the printing resolution of a liquid ink printer, since printing throughput is proportional to the carriage velocity, V, relative to the recording medium and to the active printing length, L, of the printhead, where the printing length L equals N×S where N is the total number of channels on the printhead. The carriage velocity V is equal to F×Q, where F is the nozzle firing frequency and Q is the distance between printed pixels along the scanning direction. The maximum frequency may be limited by how quickly the ink carrying channels can refill with ink, or by how quickly the full set of N channels may be fired. For example, if M is equal to 4, wherein M is equal to the number of channels fired simultaneously, having a firing pulse width of T=3 microseconds and a dead time between pulses of0.25 microseconds, then the frequency will have an upper limit of 4/(3.25×N). Consequently, in order to preserve printing throughput when resolution is increased (i.e., when S or Q are made smaller), then N and/or F must be made larger. If the upper limit to F is due to the time to ripple through the nozzles firing, then either M must be increased or T must be decreased. Producing smaller drops is synergistic with faster operation. Shorter (higher voltage) pulses produce smaller drops and less ink per drop leads to faster channel refill. Alternately, smaller heaters can be used when producing smaller drops, so more heaters can be fired simultaneously.

As the distance between adjacent drop centers in the scanning direction decreases, typically the channel width, W (see FIG. 2), also decreases. While higher resolution printheads tend to have a lower printing throughput because more dots are to be printed, the faster refill time helps to minimize the slowdown. Consequently, while printing a 1×2 print scheme may take longer than the printing of a 1×1 print scheme, the smaller and more numerous drops of the 1×2 print scheme will improve image quality in three additional ways. One, smaller spots allow smaller features to be adequately resolved. Two, smaller spots improve the quality of the gray scale that can be produced. This occurs because in a halftone, both the lightest level that can be printed and the fineness of the gray levels that can be distinguished are controlled by the smallest spot that can be printed. Three, the large pixel overlap of adjacent drops one-half pixel spacing apart can also improve the number of gray levels.

Figure 4:
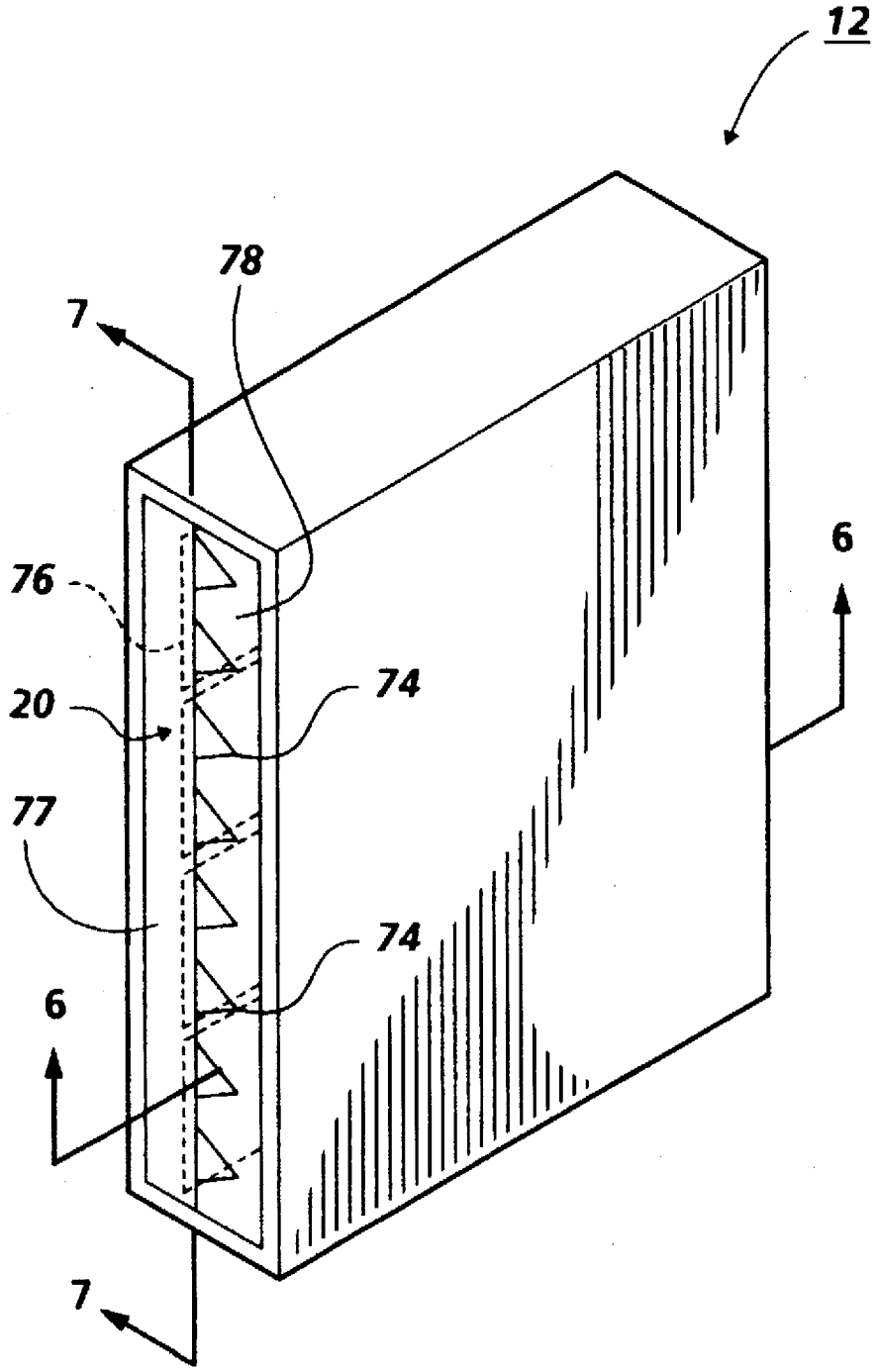
FIG. 4 is a schematic perspective view of an ink jet print cartridge having an ink jet printhead with ink ejecting nozzles and associated heaters therefore incorporating the present invention.

While a printer printing an actual 1×2 print scheme includes the above-mentioned advantages and disadvantages, such a printer could also require an additional 25% ink usage when compared to 1×1 printing. However, the printer of the present invention which includes the printhead cartridge 12, as illustrated in FIG. 4, cleverly regains the additional ink required by placing two nozzles over a single heater to produce two small drops simultaneously. The printhead cartridge 12, therefore, includes the printhead 20 having a plurality of nozzles 74, wherein two of the nozzles are placed in cooperative association with a single heater 76. The single heater 76 vaporizes the ink which is located adjacent to the heater, and consequently upon vaporization thereof, ink is expelled from two of the nozzles 74 simultaneously.

The ink jet printhead 20, or a printhead die, includes a transducer element 77,or a heater die, including resistive heaters, and an ink directing element 78, or a channel die. The channel die includes an array of ink conduits or fluidic channels which bring ink into thermal contact with the transducers which are correspondingly arranged on the heater die. Channel dies can be made of silicon, glass, plastic, or other known materials in which ink carrying conduits can be formed. In addition, the printhead die may also have integrated addressing electronics and driver transistors.

Fabrication yields of die assemblies at a resolution on the order of 300–600 channels per inch is such that the number of channels per die is preferably in the range of 50–600 under current technological capabilities. Because thermal ink jet nozzles typically produce spots or dots of a single size, high quality printing requires the fluidic channels and corresponding heaters to be fabricated at a high resolution on the order of 300–1200, or more, channels per inch.

In an orientation dependent etching method of channel fabrication on silicon wafers, the channels are triangular shaped with a height equal to 0.707 times the channel width. For orientation dependent etching of silicon, a standard channel width for 300 spot per inch (spi) printing is approximately sixty-six microns and for 600 spot per inch printing is twenty-five microns.

Figure 5:
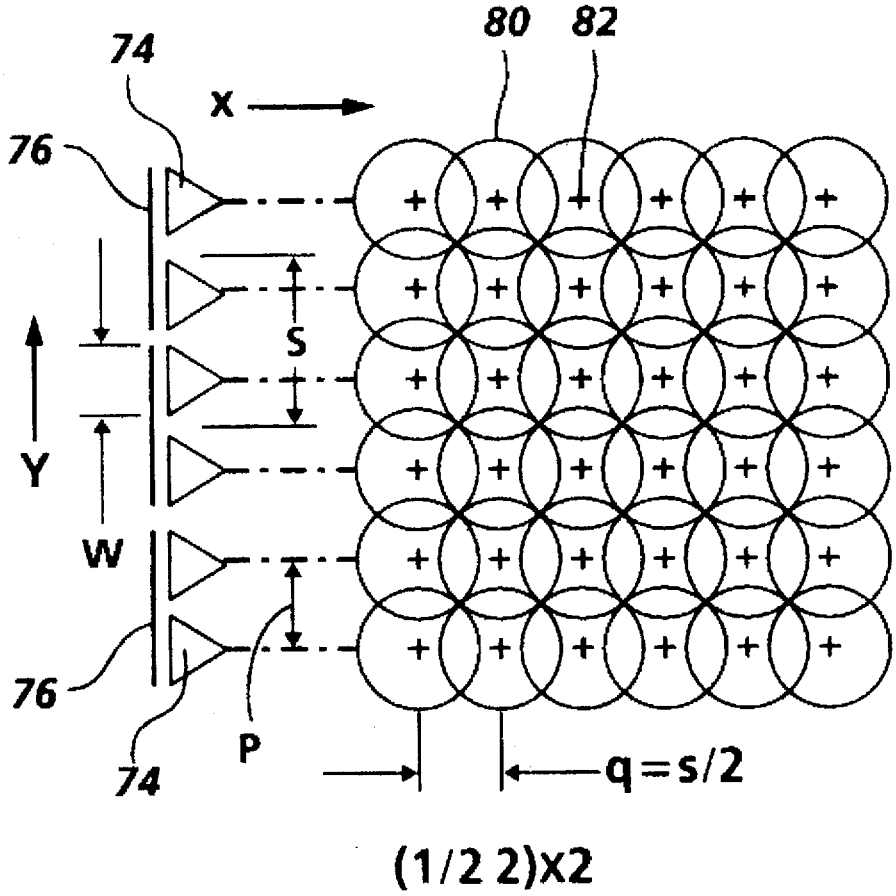
FIG. 5 illustrates the locations of ink drops deposited by the printer of the present invention.

As illustrated in FIG. 5, a plurality of ink drops 80 having pixel centers 82, deposited by the printhead of FIG. 4, is illustrated. Since every two nozzles eject ink under the control of a single heater 76, having centers spaced a distance, S, apart, the printing scheme is not a true 1×2 but is instead a (½×2)×2 print scheme, also referred to herein as "apparent 1×2 printing". While the transducer spacing is S, the spacing between adjacent drops in the X or scanning directing, which is controlled by the controller 21, is selected as a function of S divided by the number of nozzles simultaneously ejecting ink under control of a single transducer. If FIG. 2 represents 300×300 spi, then FIG. 5 has the appearance of solid area coverage at 600×600 spi. In fact, however, this new configuration is more like 300×600 spi, but with an oblong spot (formed by the simultaneous ejection through a pair of nozzles which is optimized for low ink usage and gray scale.

As shown in FIG. 5, the pitch P has been chosen such that two 600 spots per inch drops are placed on standard 600 spot per inch spacings in the Y direction. If the nozzle size is 25 micrometers, the spacing between nozzles is approximately 17.5 micrometers. This spacing requires a distance from the first edge of one nozzle in a pair of nozzles to the opposite edge of the second nozzle to be 67.5 micrometers. As another example, if the nozzle size is 30 micrometers, the spacing between adjacent nozzles would be 12.5 micrometers and the spacing between opposite edges, would be equivalent to 72.5 micrometers. In this instance, the total ink usage for full coverage could be:

$$(\tfrac{1}{2}\times 2)\times 2:\ 2\times(2\times 0.71^2)=2$$

This amount is comparable to the ink usage for 1×1 printing. It has been found, that the overall area of the (½×2)×2 pixel is even smaller than the true 1×2 pixel. Consequently, the lightest gray level that can be printed is further improved for the (½×2)×2 design. In addition, the advantages of a distributed ink flow still apply and therefore a significant throughput advantage for a printer configured to print in (½×2)×2 addressability may be possible. Furthermore there is an advantage in the number of heaters which can be fired simultaneously, in printheads printing a single line of pixels in a burst of several banks of nozzles, wherein each bank prints a segment of a line. In these types of printheads, the banks of nozzles are typically fired sequentially and the nozzles within a bank are fired simultaneously. Refer to U.S. Pat. No. 5,300,968 to Hawkins incorporated herein by reference. In such a printhead, for true 600×600 spot per inch printing with 256 nozzles per printhead die, eight individual heaters are fired simultaneously in order to ripple through all 256 nozzles (at a 3.25 microsecond pulse separation) in order to achieve a firing frequency of 6 kilohertz. For the present invention, however, since there are only 128 heaters for 256 channels, only four heaters need to be fired at once. Fewer heaters fired simultaneously is preferable since the less heaters fired at a time reduces the voltage drops in the heater die due to parasitic resistances within a printhead. In addition, the heaters could also be made smaller since the amount of ink ejected per nozzle is less.

Figure 6:
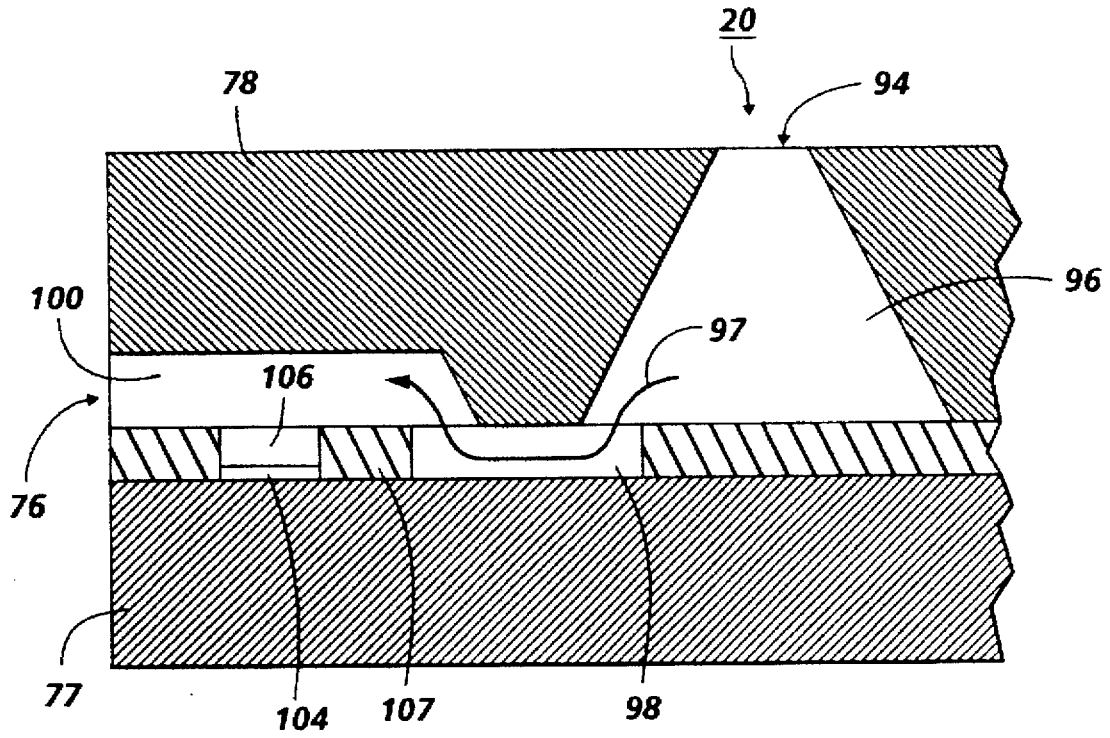
FIG. 6 is a partial schematic side view of the printhead illustrated in FIG. 4 along the line 6—6.

FIG. 6 illustrates a partial schematic side view of the printhead 20 along the line 6—6 of FIG. 4. The printhead element 20 includes the ink directing element 78 mated and aligned to the transducer element 77. The printhead element 20 receives ink from a supply of ink (not shown) through an ink feed slot 94 defined in the ink directing element 78. Ink passes through the ink feed slot 94 into an ink reservoir 96 which contains an amount of ink which eventually flows therefrom in the direction of an arrow 97 through an ink pit 98, through a channel 100, and out through one of the plurality of nozzles 76 defined by the mated ink directing element 78 and transducer element 77. During printing, a heater 104 located beneath a heater pit 106, also filled with ink, begins to vaporize the ink above the heater 104. A pit wall 107 separates the heater pit 106 from the ink pit 98. A vapor bubble is created which ejects a certain amount of ink from the nozzle 76. Once the ink is ejected from the channel 100, ink again flows in the direction of the arrow 97 by capillary action to refill the channel 100 and the heater pit 104 for subsequent ejection of ink.

Figure 7:
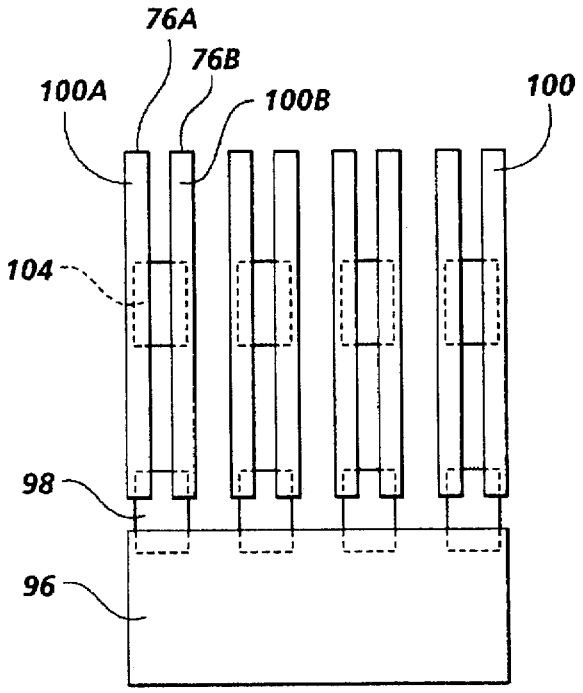
FIG. 7 is a partial schematic plan view of the printhead illustrated in FIG. 4 along the line 7—7.

FIG. 7 illustrates a partial schematic plan view of one embodiment of the present invention along the line 7—7 of FIG. 4. Two of the ink channels 100, also known as ink carrying conduits, terminate in the nozzles 76. Each pair of ink carrying conduits 100 is respectively located adjacently to one of the heater pits 104. The ink reservoir 96, as previously described, holds ink for its eventual discharge through the nozzles. The single heater 106 vaporizes the ink present in adjacently located channels 100A and 100B. While the heater pits, and consequently the individual heaters are spaced at a first pitch, the channels are spaced at a pitch which is half that of the heater pitch spacing or at a frequency that is twice the spacing. In this particular embodiment, the channels extend to the bypass pit 98 to thereby allow ink flow between the ink reservoir 96 and the respective channels. Such a configuration is possible for a spacing of 600 spots per inch between adjacent nozzles under the current available techniques of etching silicon wafers. It is also possible, however, that future designs can have nozzle spacings of 1200 spots per inch or greater with heater spacings of one-half that amount.

Figure 8:
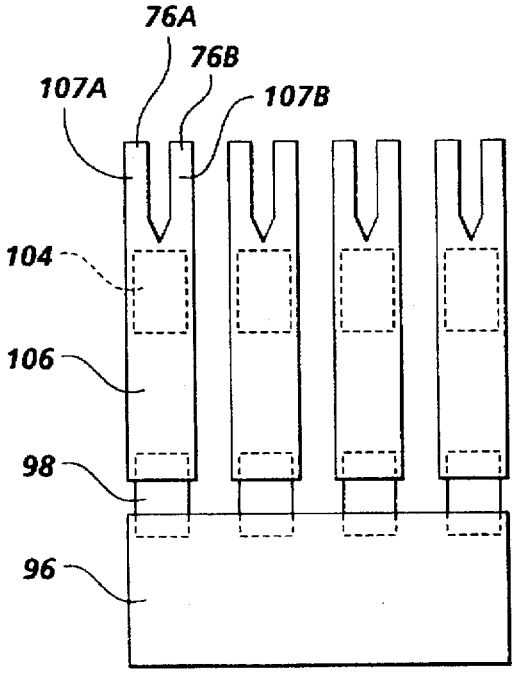
FIG. 8 is a partial schematic plan view of another embodiment of the printhead of the present invention.

FIG. 8 illustrates a partial schematic plan view of another embodiment of the printhead of the present invention. In FIG. 8, however, a plurality of channels or ink carrying conduits 106 are of a standard channel width, for example, for 300 spot per inch printing. In such a configuration, each of the channels 106 is located directly adjacent to one of the heater pits 104 and its associated heater. This embodiment, however, differs, from the example of FIG. 7, in that the single channel 106 is divided into the first and second nozzles 76A and 76B, by a branched portion having a first branch 107A and a second branch 107B which is forked by a timed ODE etch to produce two small nozzles at the jetting end. As was previously described for FIG. 7, the embodiment of FIG. 8 includes a single heater element per every two nozzles but differs in that this particular configuration has a single heater element for every single channel.

Figure 9:
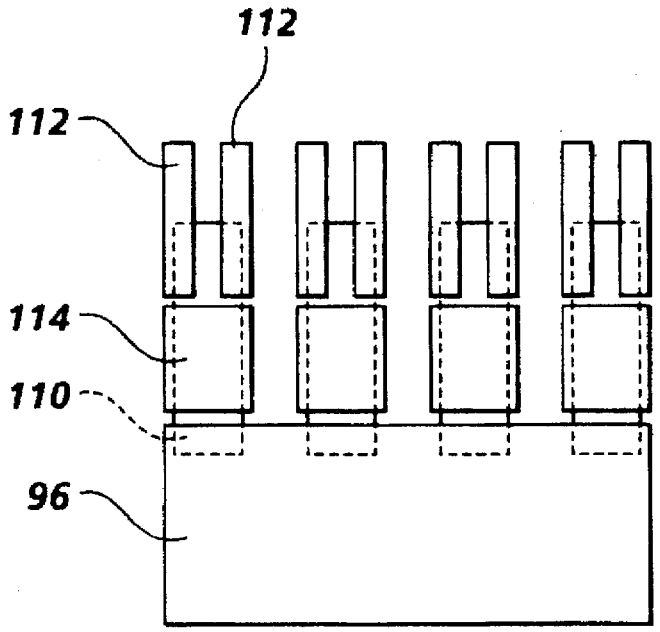
FIG. 9 is a partial schematic plan view of another embodiment of the printhead of the present invention.

FIG. 9 illustrates a third alternate embodiment of the present invention which does not include a pit wall separating a heater pit from an ink pit, as previously shown in FIG. 6. Consequently, the FIG. 9 embodiment includes a single bypass pit 110 which allows ink flow directly from the ink reservoir 96 to the heater element. A plurality of individual channels 112 spaced at, for example, 600 spots per inch are operatively connected to a connecting channel 114 by the bypass pit 110. Such a configuration might be optimized so that jetting parameters such as drop velocity, drop volume, and refill frequency are optimized for the particular ink being used and the required range of printing conditions.

Figure 10:
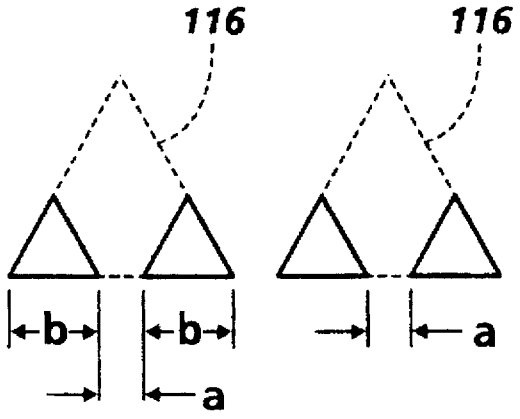
FIG. 10 is a partial schematic elevation view of the nozzles of the present invention.

FIG. 10 illustrates a schematic front view of the individual nozzles, formed by etching channels in silicon, of the present invention with respect to the nozzle openings of a printhead having printhead nozzles spaced at 300 spots per inch. A spacing distance of A is approximately 17 micrometers while the width of the channels, 13, is 25 micrometers. 300 spot per inch channel nozzles 116 are shown in dotted outline to illustrate the respective size of the larger and the smaller nozzle openings. FIG. 10 may also be understood to represent the front view of the FIG. 8 embodiment where the dotted line represents the channel 106 coupled to two nozzles 76.

Because the described embodiments typically fire banks of heaters sequentially to eject ink throughout the linear array of nozzles, the printhead must be slightly tilted with respect to the scanning to stitch in order to stitch together printhead passes correctly, the tilt of the printhead for 1×2 printing must be one-half pixel. While it is possible to print images by tilting the printhead at one-half pixel, firing banks of nozzles sequentially has inherent difficulties when printing full coverage. For instance, interactions in the ink being ejected from the nozzles limits the frequency that the device can be operated. Additionally, for some ink formulations overlapping the individual ink drops from adjacent pixels fired together does not leave sufficient time for drying, leading to increased paper curl and bleeding. Possible solutions include ejecting ink from alternate nozzles simultaneously. Firing the alternate nozzles simultaneously may not necessarily solve the problem of ink flow interactions, however. Another possible solution is to change the order in which banks of nozzles are fired with a corresponding change to the tilt of the printhead.

One possibility is to eject ink from a first bank of nozzles at the topmost portion of the printhead followed by ejecting ink from a second bank of nozzles located just past one-half way down the printhead by tilting the printhead by one pixel instead of one-half pixel. Spots deposited by the second bank are automatically displaced one-half pixel from spots deposited by the first bank. After these two banks eject ink, the second bank from the top half of the printhead array ejects ink followed by the second bank from the bottom half of the printhead array ejecting ink. Thereafter, alternating banks from the top half and the bottom half of the printhead eject ink. Tilting the printhead a larger amount permits a greater distribution of the firing pattern. Other modes are also possible where widely separated nozzles are fired simultaneously. For example, in printhead having 256 nozzles, every 32nd nozzle is fired such that nozzle 1, 33, 65, 97, 129, 161, 193, and 225 are fired initially. In the second print cycle nozzles 2, 34, 66, 98, 130, 162, 194, and 226 are fired. For such a print scheme, the printhead tilt should be four pixels. Then with nozzle 1 centered on a 1×2 pixel position, nozzle 33 will be displaced by one-half pixel therefrom, nozzle 65 by one pixel, nozzle 97 by one and one-half pixel, and so on to where nozzle 226 is tilted by three and one-half pixels. Thus, all the pixels automatically line up on a 1×2 grid. Such a mode of printing has the optimum distribution of ink flow throughout the system.

In addition, it is possible to print images in two passes of the printhead as opposed to one. Certain advantages of a two pass print scheme include allowing the ink to dry between passes, simultaneously firing alternate nozzles, masking printhead signatures by printing adjacent spots with different portions of the printhead, and printing single pass ink-saving draft print modes. In each pass, odd and even pixels are placed on centers separated by one-half pixel in the scanning direction by firing the odd nozzles and the even nozzles separately and controlling the order in which they are fired. For instance, in a first pass, wherein eight nozzles can be fired simultaneously, banks of odd nozzles, for instance, 1, 3, 5, and so on, are fired starting at the top of the printhead and then the second bank of odd nozzles 17, 19 on up to 31 progressing to the bottom. Printing in this scheme completes in half the print cycle time for all of the odd fired nozzles. Once the odd nozzles are printed, then the even nozzles are fired, starting at the top of the printhead 2, 4 on up to 16 and progressing to the bottom. If the printhead speed across the paper is one pixel per print cycle, then the odd nozzles will be placed on 1×1 pixel positions and the even nozzles will displaced by one-half pixel on the one-half pixel positions. On the second pass the evens are fired first, followed by the odds. The evens will be on the 1×1 pixel positions and the odds on the 1×2 pixel positions. In order to maintain the correct placement of the drops, the printhead should be tilted one-half pixel.

Figure 11:
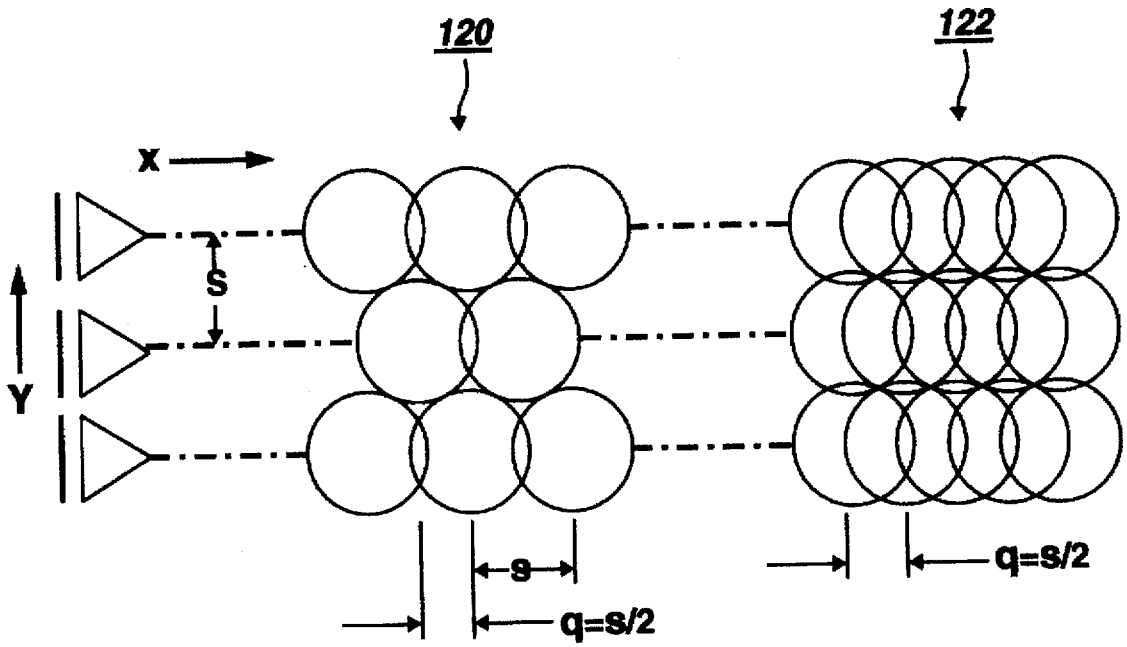
FIG. 11 illustrates the locations of ink drops deposited by a printhead printing a two pass, 1 by 1 pattern.
Figure 12:
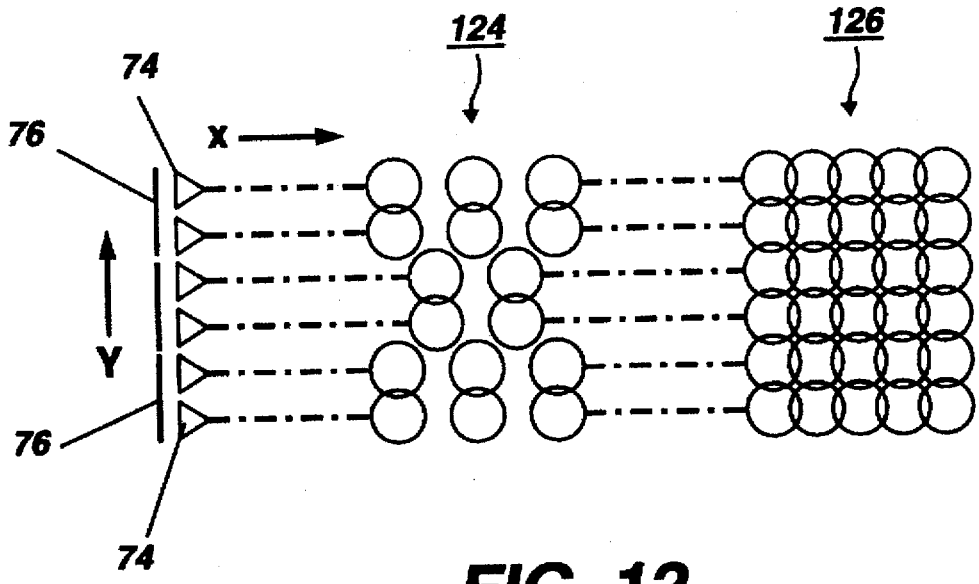
FIG. 12 illustrates the locations of ink drops deposited by a printhead of the present invention printing a two-pass, 1 by 2 pattern.

FIG. 11 illustrates a two pass print scheme for a true 1×2 print scheme. A single pass 120 of the printhead illustrates that a relatively high ink coverage of the recording medium is possible with minimum pixel overlap therefore making a good ink conserving draft print mode. Once the second pass has been completed, a two pass print scheme 122 illustrates that full coverage has been achieved. As further illustrated in FIG. 12 (see also FIG. 4), the printhead of the present invention having two nozzles 74 per transducer deposits ink drops by firing odd transducers on odd numbered columns and even numbered transducers in even numbered columns in a first pass print 124 of the printhead. A second pass of the printhead deposits ink drops by firing even numbered transducers on odd numbered columns and odd numbered transducers on even number columns to provide full coverage printing 126. It also possible to print only the first pass 124 for draft mode printing.

Figure 13:
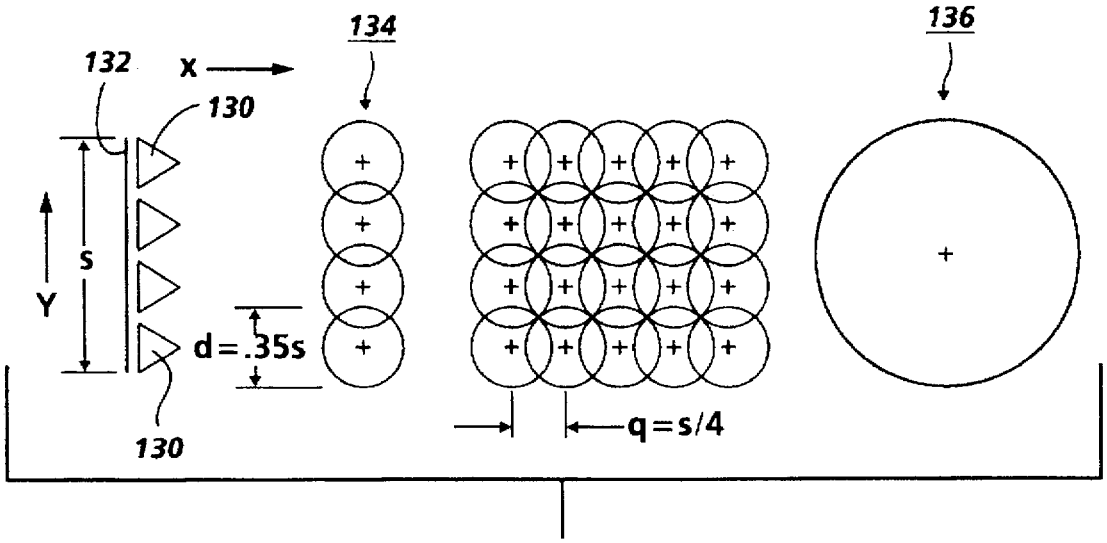
FIG. 13 illustrates the locations of ink drops deposited by a printhead printing a 1 by 4 pattern.

While the present invention has been described with respect to two nozzles per heater, the present invention is not limited thereto, and can include any plurality of N nozzles per heater. For instance, as illustrated in FIG. 13, four individual nozzles 130 eject ink simultaneously under control of a single transducer 132 to print images having 1×4 addressability. Each bank of four separate nozzles produces a single drop, also known as a subpixel, when the heater is fired. The result is a tall, narrow pixel 134 which can be deposited one, two, three or four times in the area of a standard size single normal pixel 136. Consequently, the four nozzles per heater can achieve five different gray levels, including white, whereas in normal printing there are only two. Furthermore, the lightest gray level is less than one-quarter of the lightest level in the purely binary case. Another advantage is that the total ink usage is less than full black because the ink is already spread out on the paper, since a number of small drops are made to create one single large drop.

Figure 14:
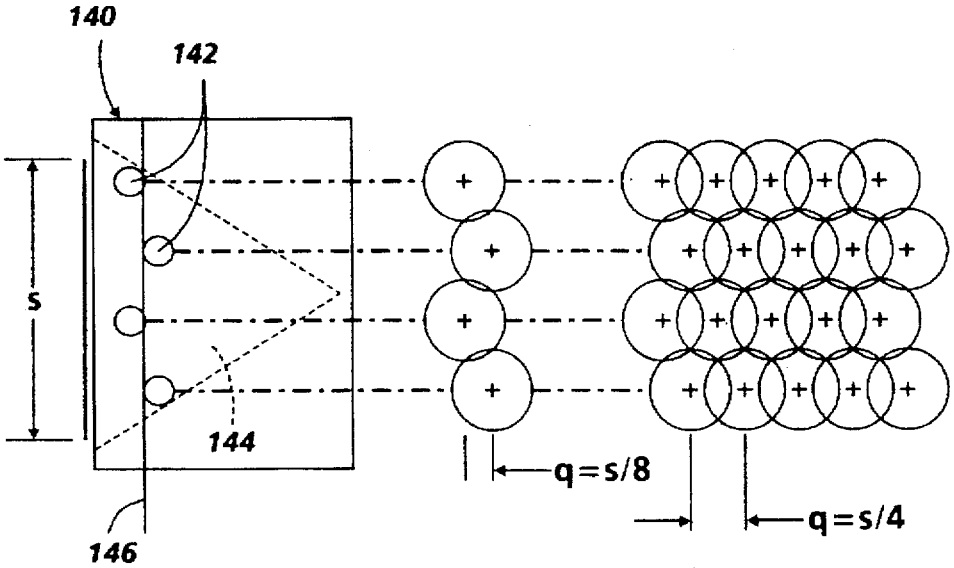
FIG. 14 illustrates the locations of ink drops deposited by a printhead having an orifice plate having a staggered array of nozzles.

As illustrated in FIG. 14, it is not necessary that the drops be arranged in a straight line, particularly if an orifice plate 140 having a plurality of staggered apertures 142 is placed over the top of a single channel 144. The individual apertures in the aperture plate 140 are staggered about a line 146 by a distance S divided by 8. By staggering the nozzles and printing with a one pass print scheme, the ink needed for full coverage is reduced by approximately one-third.

In recapitulation, there has been described a liquid ink printer printing images having increased resolution and additional levels of gray scale. While resolution is increased, the amount of ink necessary to print images according to the present invention is the same as that required for a lower resolution printer of the same type. It is, therefore, apparent that there has been provided in accordance with the present invention, an apparent 1×N liquid ink printer that fully satisfies the aims and advantages hereinbefore set forth. While this invention has been described in conjunction with a specific embodiment thereof, it is evident that many alternatives, modifications, and variations will be apparent to those skilled in the art. For instance, the present invention is not limited to scanning type liquid ink printers, but includes pagewidth printers as well which either have a moving printbar or a stationary printbar depositing ink on a recording medium advanced past the printbar. Likewise, the present invention, is not limited to sideshooter type printheads, but also includes roofshooter type printheads. In addition, the present invention includes printheads having a variety of channel/nozzle configurations within a single printhead or within a printhead cartridge. For instance, a single printhead cartridge could include a first eight channels, each having one nozzle per channel, a second eight channels, each having two nozzles per channel and a third eight channels, each having four nozzles per channel. Such a printhead cartridge has a wider range of gray scale printing than printhead cartridges having only one type of channel/nozzle configuration. Accordingly, it is intended to embrace all such alternatives, modifications and variations that fall within the spirit and broad scope of the appended claims.

What is claimed is:

1. An ink jet printing machine for depositing liquid ink on a recording medium, comprising:

a printhead, including a plurality of thermal transducers, generating thermal energy and having centers spaced a first distance apart, a plurality of ink conduits for bringing the liquid ink into thermal contact with said plurality of thermal transducers, and a plurality of nozzles, each of said plurality of ink conduits terminated by at least one of said plurality of nozzles, and each of said plurality of thermal transducers cooperatively associated with a number of said plurality of nozzles, the number being at least two; and means for moving said printhead, in a scanning direction, across the recording medium to deposit the liquid ink thereon at locations separated, in the scanning direction, by a second distance being equal to the first distance divided by the number of said plurality of nozzles cooperatively associated with each of said plurality of transducers.

2. The printing machine of claim 1, wherein said printhead comprises a transducer element including said plurality of transducers.

3. The printing machine of claim 2, wherein said printhead comprises an ink directing element including said plurality of nozzles, said ink directing element aligned with and mated to said transducer element.

4. The printing machine of claim 3, wherein said plurality of nozzles comprises a linear array of nozzles.

5. The printing machine of claim 4, wherein said means for moving comprises means for moving said linear array of nozzles across said recording medium in a direction substantially transverse to said linear array of nozzles.

6. The printing machine of claim 3, wherein said plurality of nozzles comprises a staggered array of nozzles, each of said plurality of nozzles alternately located on opposite sides of a straight line.

7. The printing machine of claim 1, wherein each of said plurality of ink conduits is terminated by at least two of said plurality of nozzles.

8. The printing machine of claim 7, wherein each of said plurality of ink conduits includes at least two branches, each of said at least two branches being terminated by one of said plurality of nozzles.

9. The printing machine of claim 8, wherein said ink directing element comprises a silicon structure, said plurality of ink conduits and said branches defined by an etching process.

10. The printing machine of claim 1, wherein each of said plurality of ink conduits is coupled to only one of said plurality of nozzles.

11. The printing machine of claim 10, wherein said ink directing element comprises a silicon structure, said plurality of ink conduits defined by an etching process.

12. The printing machine of claim 8, wherein said ink directing element comprises a plurality of feed channels, each of said feed channels operatively coupled to at least two of said plurality of ink conduits.

13. The printing machine of claim 12, comprising a transducer element including said plurality of transducers and a plurality of pit structures, each of said pit structures disposed adjacent to one of said feed channels and to at least two of said plurality of ink conduits, said one of said feed channels operatively coupled to said at least two of said plurality of ink conduits by one of said plurality of pit structures.

14. The printing machine of claim 13, wherein said plurality of transducers comprises a linear array of thermal transducers.

15. The printing machine of claim 14, wherein said linear array of transducers comprises a plurality of banks of transducers, each of said plurality of banks of transducers including a portion of said plurality of transducers with said potion being activated simultaneously and each of said banks of transducers being activated sequentially.

16. The printing machine of claim 1, further comprising a controller coupled to said moving means, controlling said moving means to enable said printhead to deposit ink drops at first locations and at second locations spaced from the first locations, in the scanning direction, a printing distance substantially equal to the distance between the centers of adjacent nozzles of said plurality of nozzles.

17. A method of printing an image on a recording medium with a liquid ink printhead, moving in a scanning direction, having a plurality of transducers ejecting ink droplets through a plurality of nozzles, having centers spaced a distance apart, on a recording medium, comprising the steps of:

depositing a first plurality of ink droplets simultaneously, having centers spaced the distance apart, by energizing one of the plurality of transducers; and depositing a second plurality of ink droplets simultaneously, spaced from the first plurality of ink droplets by a distance equal to the distance apart in the scanning direction.

18. The method of claim 17, wherein said second depositing step comprises depositing the second plurality of ink droplets simultaneously by energizing the one of the transducers.

19. The method of claim 18, wherein said first depositing step comprises depositing the first plurality of ink droplets with the liquid ink printhead including an ink directing element having a plurality of ink conduits coupled to an array of spaced nozzles, having centers spaced the distance apart, and a transducer element having an array of transducers, the transducer element aligned with and mated to the ink directing element such that each of the transducers is substantially aligned with at least one of the plurality of ink conduits.

20. The method of claim 19, further comprising controlling the printhead to deposit the first plurality of ink droplets at first locations and to deposit the second plurality of ink drops at second locations spaced laterally from the first locations in the scanning direction a distance substantially equal to the distance between the centers of adjacent nozzles of the array of nozzles.

21. The method of claim 20, wherein said first depositing step comprises depositing the first plurality of ink droplets with a thermal transducer generating thermal energy.

22. The method of claim 21, wherein the second depositing step comprises depositing the second plurality of ink droplets with a thermal transducer generating thermal energy.

* * * * *